US006579134B1

(12) United States Patent
Fiebing

(10) Patent No.: US 6,579,134 B1
(45) Date of Patent: Jun. 17, 2003

(54) USER-PROPELLABLE SPORT BOARD DEVICE

(76) Inventor: Jon Fiebing, 168 Maple Ave., Carlsbad, CA (US) 92008

( * ) Notice: Subject to any disclaimer, the term of this patent is extended or adjusted under 35 U.S.C. 154(b) by 0 days.

(21) Appl. No.: 10/045,203

(22) Filed: Jan. 15, 2002

(51) Int. Cl.[7] ..... B63H 16/00
(52) U.S. Cl. ..... 440/21; 440/22; 440/14
(58) Field of Search ..... 440/21, 25, 14, 440/22, 12.55, 12.62; 441/65, 76, 77

(56) References Cited

U.S. PATENT DOCUMENTS

| | | | | |
|---|---|---|---|---|
| 3,711,108 | A | 1/1973 | Orozco et al. | 280/251 R |
| 4,321,048 | A | 3/1982 | Marchese et al. | 440/32 |
| 4,389,195 | A | 6/1983 | Sohaei | 440/15 |
| 4,642,056 | A | 2/1987 | Keivanjah | 440/15 |
| 4,708,675 | A | 11/1987 | Shoeffler et al. | 441/65 |
| D346,193 | S | 4/1994 | Bryce | D21/227 |
| 5,613,695 | A | 3/1997 | Yu | 280/14.2 |
| 6,007,101 | A | 12/1999 | Pritchard et al. | 280/809 |

FOREIGN PATENT DOCUMENTS

| | | | | |
|---|---|---|---|---|
| DE | 3431660 | A1 * | 3/1986 | B63H/16/08 |

* cited by examiner

*Primary Examiner*—Jesus D. Sotelo
(74) *Attorney, Agent, or Firm*—Mary Jo Redman; Calif Tervo

(57) ABSTRACT

A sportboard device (10) for movement over a fluid medium, including water, snow, or ice; including a plurality of pivotable fin assemblies (20) for transferring force from the user's feet to the fluid. Fin assembly (20) includes foot platform (30), transmission shaft (51), and fin (21). User stands on foot platforms (30) with feet secured by strap (34), binding (35), or friction surface (36). Twisting the feet pivots foot platforms (30). Torque is transmitted through shaft (50) to fin (21), causing fin (21) to pivot against the fluid medium. Coordinated movements of foot platforms (30) cause sportboard (10) to move relative to the fluid in the absence of gravity, wind, or wave force or in a direction different from that of the natural force.

19 Claims, 2 Drawing Sheets

USER-PROPELLABLE SPORT BOARD DEVICE

FIELD OF THE INVENTION

This invention relates generally to modifications to sportboards, and more particularly to surf boards, windsurfers, or snowboards with pivotable fin assemblies that allow the sportboards to be propelled forward by the user's feet.

BACKGROUND OF THE INVENTION

Many sports involve moving over water or snow while standing on one or two boards or blades. Surfing, snowboarding, and windsurfing are examples of sports that require the participant to stand on a single board that is supported by water or snow. In these sports, the board is moved forward by wave energy, gravity, or wind, respectively, while the participant steers by shifting his or her center of gravity or by moving a sail.

Propelling the board when the standard source of energy is absent can be problematic. Surfers normally lie on the surfboard and paddle with both arms to move opposite the flow of wave energy. This is a very traditional part of surfing but has some drawbacks. Paddling is slow and requires very strong shoulders and back. The prone position makes it hard for the surfer to see obstacles and requires the head to be held up in an uncomfortable position.

Snowboarders often release one boot from its binding and use that foot to propel the snowboard on level snow, much like a skateboard. In addition to the necessity of releasing and refixing the binding, the weight shift needed to push, then glide, is unstable and requires the attached leg to be turned at an unnatural 90° angle, thus can cause falling. Pushing against soft powder snow with a boot is inefficient and can also lead to a fall when the boot sinks deeper than expected.

A snow skier can move rapidly forward on level ground or on a slight uphill incline by employing the skis independently in a technique called skating. Each ski in turn is pivoted at an angle from the direction of forward movement, rotated relative to the surface of the snow, and pushed against the snow in a direction substantially opposite to the desired direction of travel.

The present invention uses a similar technique to allow a single sport board to be propelled forward by means of two independently-pivotable fin assemblies. Although similar to skating, the technique is also closely allied to sculling or the motion of some fish. By altering the shape and size of the fins, this invention can be used on water for surfboards and windsurfers or on snow by snowboards or sleds.

The present invention provides a means for sport boards to be propelled by the user's own energy when necessary. The propelling means is operable while in a standing position and actuated by the powerful muscles of the legs.

Also, the propulsion means of the present invention does not interfere with the functioning of the sportboard while employed for its primary use of harnessing wave, wind, or gravity power. Using this means for propelling the sport board is interesting, novel, and fun.

SUMMARY OF THE INVENTION

This invention is a user-propellable sportboard for moving over water or snow. Although typically accelerated by the force of wind, waves, or gravity, the sportboard can alternatively be propelled by the user's muscle power when the preferred element is lacking or not moving in the desired direction.

In a preferred embodiment, the sportboard includes two pivotable fin assemblies, each of which is powered and controlled by one of the user's feet. Each fin assembly comprises a foot platform, a fin, and a transmission shaft to transfer torque from the foot platform to the fin.

Typically, the sportboard of the present invention has two fin assemblies mounted on it. The foot platform may be above the deck of the board or may recessed into it. The user's foot engages a platform by means of a binding, stirrup, or frictional surface.

The user's foot is pivoted to pivot the platform. A transmission means, such as a shaft, connects the platform to the base of the fin, typically by passing through a hole bored through the body of the board. The shaft transmits the pivoting motion of the platform to the fin.

The fin pivots and exerts force on the water or snow under the board. By properly coordinated foot and body movements, the user produces a sculling effect that propels the sportboard forward. The fin assemblies can work in unison by pivoting the feet in tandem or can yield a stronger propulsion effect when operated independently. The optimal shape and size of the fins will vary according to condition of the snow or water and expertise of the user. If desired, gears are included in the transmission means to increase the power of the stroke.

Fin assemblies can be mounted such that they are semi-permanent, or easily demounted in the field. The user may change fin type to suit conditions, or may prefer to use the sport board without fins.

The sportboard is propelled by a person standing on the platforms, allowing use of the leg muscles for propulsion, good visibility, and a comfortable position of the neck. The fin assemblies can be operated with very little skill or practice, but are employed more efficiently and elegantly after some practice. This makes use of the propulsion means challenging and enjoyable both for a novice and for a more skilled user.

DETAILED DESCRIPTION OF THE DRAWINGS

Figure 1:
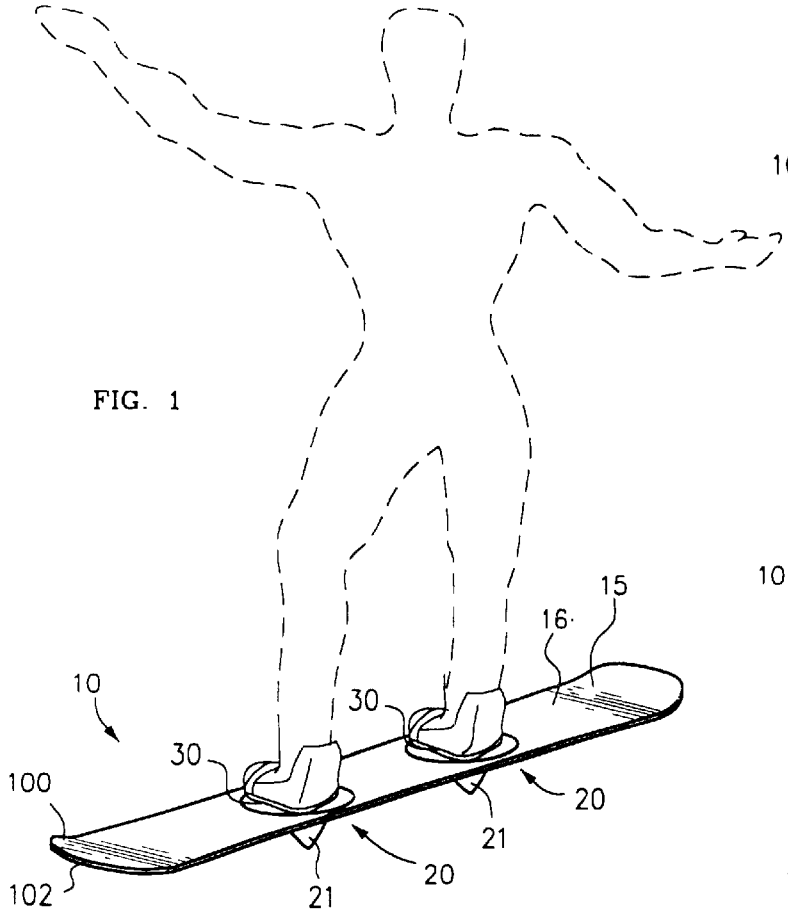
FIG. 1 is a perspective environmental view of a snowboard embodiment of the sportboard device, showing a user in phantom.
Figure 2:
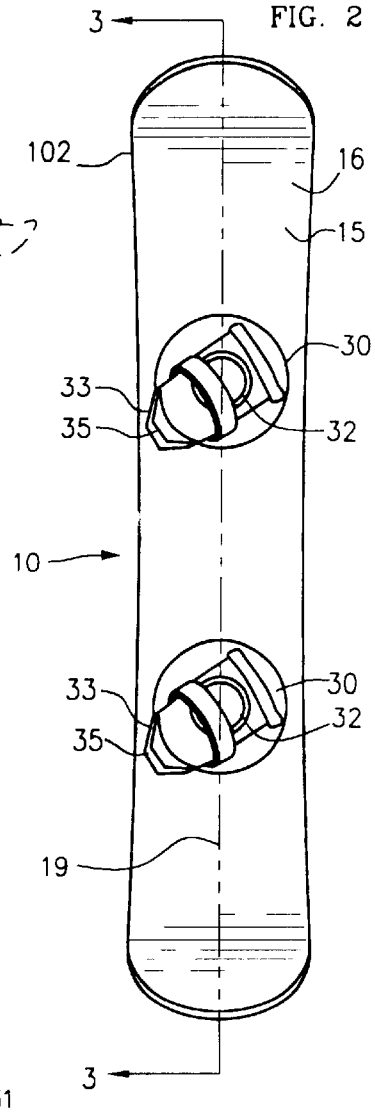
FIG. 2 is a top view of a snowboard embodiment of the sportboard device of FIG. 1.
Figure 3:
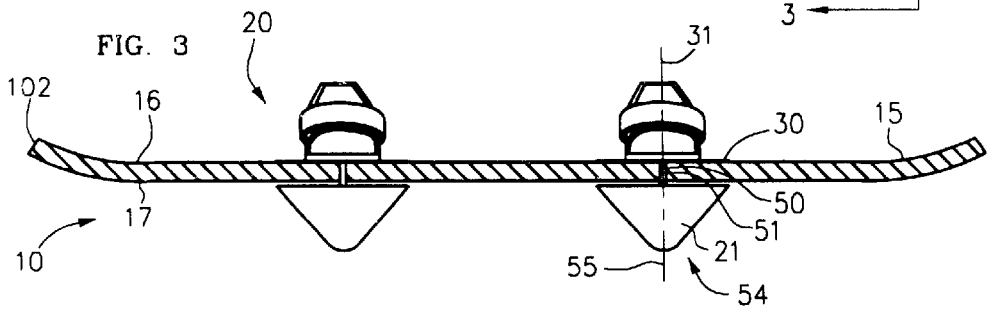
FIG. 3 is a cross-sectional view of the sportboard device of FIG. 2, taken along line 3—3.

With reference now to the drawings, in which like reference numerals refer to like parts throughout, FIG. 1 is a perspective environmental view of a snowboard embodiment 102 of the sportboard device 10, FIG. 2 is a top view of snowboard embodiment 102 of FIG. 1, and FIG. 3 is a cross-sectional view of snowboard embodiment 102 of FIG. 2, taken along line 3—3.

Figure 4:
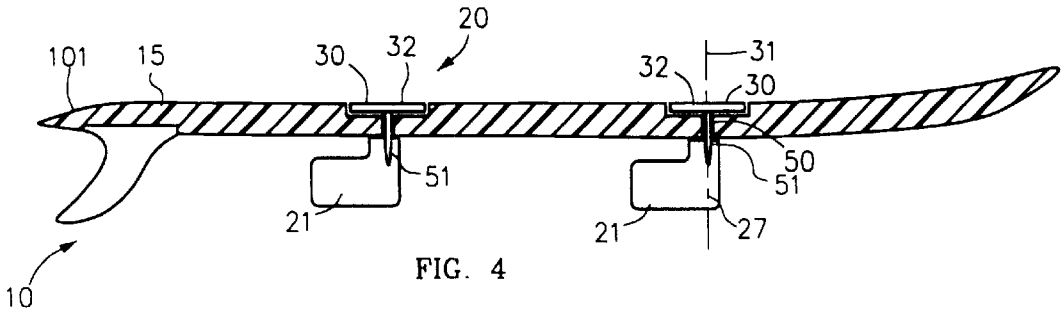
FIG. 4 is a corresponding cross-sectional view of a surfboard embodiment of the sportboard device.
Figure 5:
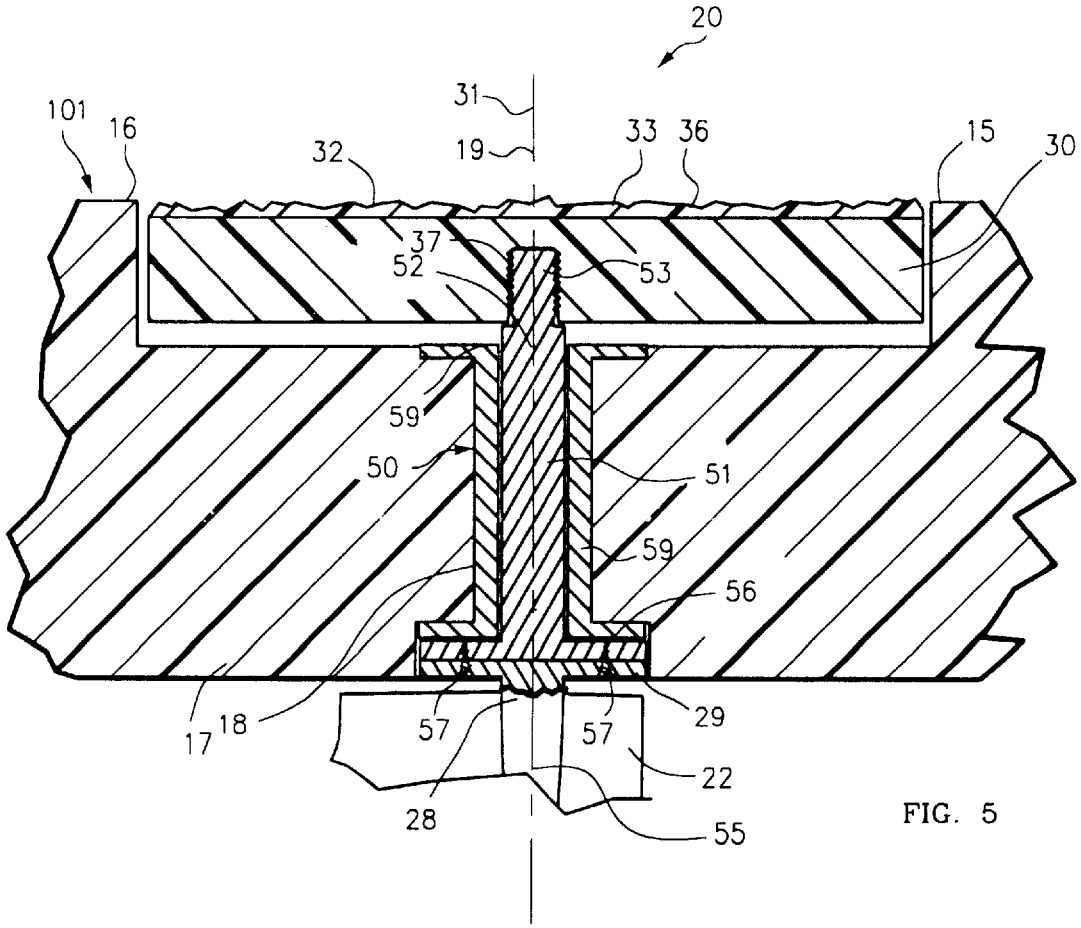
FIG. 5 is an enlarged detail view of an alternative embodiment of the fin assembly of FIG. 4.

FIG. 4 is a cross-sectional view of a surfboard embodiment 101 of sportboard device 10, corresponding to the view of FIG. 3. FIG. 5 is an enlarged detail view of the fin assembly 20 of the surfboard embodiment 101 of FIG. 4.

Sportboard device 10 generally comprises a board body 15 for being supported by a fluid medium, such as snow or water, and one or more fin assemblies 20 for propelling sportboard device 10. Body 15 includes a top 16 and a bottom 17, which is typically in contact with the fluid medium.

Fin assembly 20 includes a foot platform 30 for supporting the user's foot and fin 21 for applying force to the fluid that supports sportboard 10. Typically, foot platform 30 is disposed near top 16 of board 15, fin 21 is disposed underneath bottom 17, and a transmission means 50, such as shaft 51, connects foot platform 30 to fin 21, as seen in FIGS. 3 and 4.

As best seen in FIG. 5, foot platform 30 includes a foot engaging area 32, to which the user's foot is secured by foot securing means 33, such as frictional surface 36, a strap (not shown), or boot binding 35 of FIG. 2.

The user typically stands with each foot on one foot engaging area 32 and applies forces to foot platforms 30 by twisting the feet. Foot platform 30 pivots about platform pivot axis 31.

Foot platform 30 is connected to the upper end 52 of shaft 51 by suitable, well-known means, such as by threads, glue, or a flange. FIG. 5 shows upper end 52 including a threaded insertion pin 53 mating with a threaded portion of bore 37 of foot platform 30.

Shaft 51 has a longitudinal axis 55, which is generally perpendicular to foot engaging area 32. When foot platform 30 is twisted, torque is imparted to shaft 51 and shaft 51 pivots about axis 55. Shaft 51 is preferably a stiff, durable material such as fiber-reinforced epoxy, wood, or aluminum.

The lower end 54 of shaft 51 is connected to the base 22 of fin 21 by any means common to the art. Fin 21 and shaft 51 could be fabricated as a single unit, such as by casting of a suitable plastic, as in FIGS. 3 and 4. In the embodiments illustrated, shaft 51 is disposed substantially within a through hole 18 that passes through board body 15 from top 16 to bottom 17. To protect board 15 from wear and to maintain shaft 51 in a position perpendicular to longitudinal axis 19, through hole 18 is provided with a bearing such as a journal 59 or pair of grommets (not shown), of any suitable material.

Shaft 51 transmits force to fin 21, causing it to pivot about fin pivot axis 27. In the preferred embodiments illustrated, shaft pivot axis 58 is substantially vertical, as are fin pivot axis 27 and platform pivot axis 31.

As fin 21 pivots, the side 26 of fin 21 applies force to the fluid medium, resulting in movement of sportboard 10 relative to the fluid.

Fin 21 may have different shapes and dimensions, depending on the intended use. For example, a fin 21 used on a windsurfer embodiment 103 would be shaped so as to have a large area on side 26 but have hydrodynamic leading edge 24 and trailing edge 25 so that fin 21 does not add drag that would decrease the velocity of windsurfer 103 when under sail.

Fin 21 and shaft 51 may be firmly attached to the rest of fin assembly 20, or may be adapted for frequent removal or replacement. Attachment means well known in the art can be used so that fin 21 may be changed by the user without tools so as to suit the fin size and shape to the conditions, such as glassy or choppy water, or wet or powdery snow. Fin size and shape may also be adapted for the strength and expertise of the user. It is desirable that fin 21 and shaft 51 be removable from sportboard device 10. When fin 21 and shaft 51 are removed from sportboard device 10, no part of fin assembly 20 projects below bottom 17 of board body 15.

FIG. 5 is an enlarged view of an alternative embodiment of fin assembly 20, adapted for easy mounting and demounting by the user. In this embodiment, fin 21 includes fin shaft 28 having fin flange 29 opposite fin base 22. Lower end 55 of shaft 51 includes lower flange 56. Fin 21 is attached to shaft 51 by aligning lower flange 56 and fin flange 29 and attaching them together, such as by screws 57. To detach fin 21, screws 57 are removed, fin 21 is removed, and screws 57 may be replaced in lower flange 56 for storage. Lower flange 56 prevents shaft 51 from pulling out of through hole 18 when fin 21 is not attached. Screws 57 are preferably of non-corroding material, such as nylon or titanium, and may have a wide slot for being turned with a coin, or may include a wing-type head for being turned by the fingers.

Also, different embodiments of sportboard device 10 include different embodiments of foot platform 30. In the case of snowboard embodiment 102, foot engaging area 32 and foot securing means 33 are adapted for use with boots. The combination of foot engaging area 32 and foot securing means 33, boot binding 35, resembles an ordinary snowboard binding.

In the case of surfboard embodiment 101, foot platform 30 is adapted for use in bare foot or soft booties. Foot engaging area 32 is preferably cushioned, such as with neoprene rubber foam. Because a bare or bootie-shod foot is more compliant than a snowboard boot, foot securing means 33 does not need to be as confining as binding 35. Foot securing means 33 may be a flexible stirrup or strap 34, or frictional surface 36. Frictional surface 36 may include an indentation that fits the foot, a soft silicone or neoprene rubber surface, surfboard wax, or other means that secures the foot from slipping relative to foot platform 30 when the foot is twisted.

Also in the case of surfboard embodiment 101, it is desirable that foot platform 30 be recessed into top 16 of board body 15 sufficiently that it is still possible for the user to lie on top 16 for paddling through surf. FIGS. 4 and 5 show foot platform 30 completely recessed into board 15, such that the tops of foot platforms 30 are even with top 16.

A fin 21 for snowboard embodiment 102 would preferably be only two inches or less from base 22 to tip 23, to minimize the risk of fin 21 being caught on rocks or roots under the snow, resulting in damage to fin 21 or a fall for the user. Because snow is less yielding than water, fin 21 for a snowboard 102 does not need as much area on side 26 as fin 21 for a windsurfer 103 or surfboard 101 does.

Other transmission means 50 are contemplated but not illustrated, such as a pair of magnets, one connected to foot platform 30 and one connected to fin 21 and rotating in synchrony, or electrical servos controlled by movement of foot platform 30.

Figure 6:
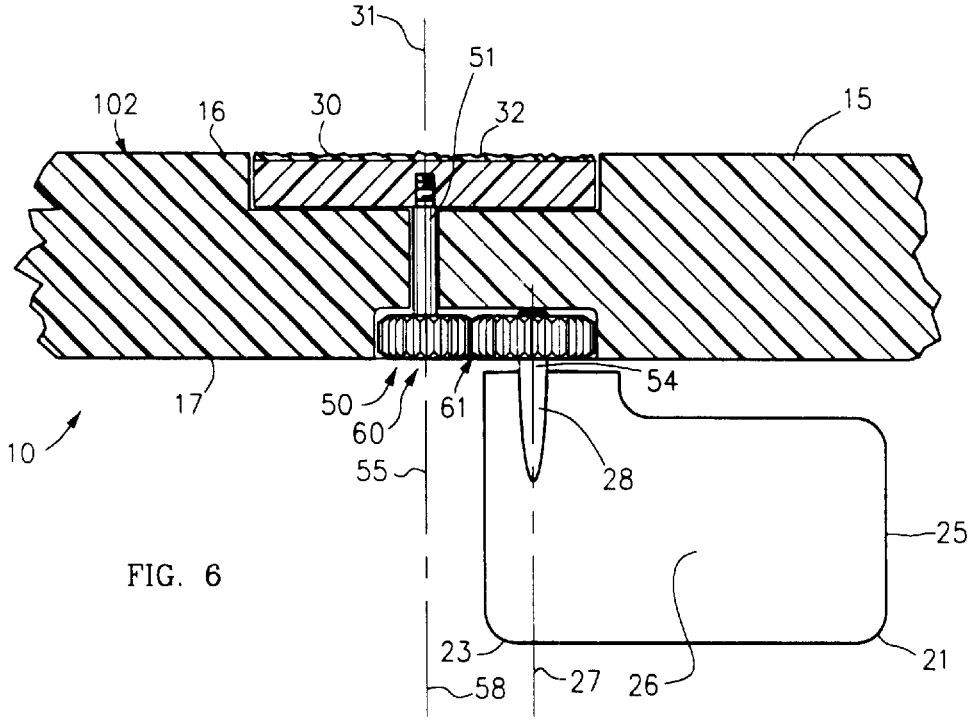
FIG. 6 is an enlarged detail view of an alternative embodiment of the fin assembly of FIG. 4.

FIG. 6 is an enlarged detail view of an alternative embodiment of the fin assembly of FIG. 4, wherein transmission means 50 includes gear means 60, such as cooperating gear wheels 61, to cause fin 21 to pivot at a different angular velocity than foot platform 30. Fin 21 could be made to pivot with greater angular displacement than foot platform 30 or with less displacement but greater power, depending on the specifications of gear wheels 61 employed.

Four modes of operating fin assemblies 20 to propel sportboard device 10 have been found: 1) the user may pivot both feet in unison in the same direction; 2) pivot both feet in the same direction with a slight hesitation between the two feet; 3) pivot the feet in opposite directions in unison; or 4) pivot in opposite directions with a slight hesitation. Progressing from mode 1 to 4 requires increasing skill but returns increasing power. Thus, the user is rewarded for practice at propelling sportboard device 10. To achieve the greatest speed, the user must develop a feel for fins 21 and the proper coordination of motions.

The illustrated embodiments of sportboard device 10 include two fin assemblies 20. Alternative embodiments, not illustrated, have more than two fin assemblies 20, or two fin assemblies 20 each having more than one foot platform 30.

Another preferred embodiment of sportboard device 10 (not shown) is a set of fin assemblies 20 that are mounted upon a board (not shown) provided by a dealer, rental shop, or by the user. In this embodiment, shaft 51 is removably attached to either foot platform 30 or fin 21, or both. The person assembling the sportboard device provides through holes 18 through the board, preferably including journal 59 or other bearing means.

Shaft 51 is detached from foot platform 30 or fin 21, shaft 51 is put into one through hole 18, and shaft 51 is re-attached to foot platform 30 or fin 21. This embodiment would be attractive to a person already having a board and wanting to make it propellable at minimal cost. Some advantages of the illustrated embodiments would be sacrificed, such as strength of the attachment of shaft 50 to foot platform 30 or fin 21.

It can be seen that the present invention provides a fun and efficient means of propelling a sportboard device. Although specific embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. A user-propellable sportboard device for motion over a fluid medium including a board adapted for support by a fluid medium; including:
- a top; and
- a bottom;

a plurality of fin assemblies mounted to said board; each said fin assembly including:
- a foot platform for supporting a user's foot, said platform having a substantially vertical platform axis, about which said platform is pivoted responsive to input of force from a user's foot;
- a fin disposed below said bottom for transmitting force to a fluid medium; said fin having a substantially vertical fin axis, about which said fin is pivotable; and
- transmission means connecting said foot platform to said fin for pivoting said fin about its fin axis responsive to pivoting of said foot platform about its platform axis.

2. The sportboard device of claim 1 wherein a said foot platform pivots independently of other said foot platforms.

3. The sportboard device of claim 1 wherein said platform axis and said fin axis are substantially parallel.

4. The sportboard device of claim 1, said foot platform including a generally planar foot engaging area for receiving and engaging a user's foot; and wherein said fin axis is substantially perpendicular to said foot engaging area.

5. The sportboard device of claim 1, said transmission means including gear means such that said fin pivots at a different angular velocity than said foot platform.

6. The sportboard device of claim 1, said transmission means including:

an elongate shaft including:
- a vertical longitudinal axis;
- an upper end joined to said foot platform; and
- a lower end joined to said fin.

7. The sportboard device of claim 6, said board further including:

a plurality of through holes passing through said board from said top to said bottom such that each said shaft is substantially disposed within one said through hole.

8. The sportboard device of claim 1, said foot platform being recessed partly into said top of said board.

9. The sportboard device of claim 1, said foot platform being entirely recessed into said top of said board such that said platform does not project above said top.

10. The sportboard device of claim 1, said fin and said transmission means being adapted for being removed such that no portion of said fin assembly projects below bottom of said board when said fin and said transmission means are removed.

11. A fin assembly for mounting on a sportboard for propelling the sportboard over a fluid medium; the sportboard having a top and a bottom;

said fin assembly including;
- a foot platform for disposition above the top of the board for supporting a user's foot, said platform having a substantially vertical platform axis, about which said platform is pivoted responsive input of force from a user's foot;
- a fin for disposition below the bottom of the board for transmitting force to a fluid medium, said fin having a substantially vertical fin axis, about which said fin is pivotable; and transmission means connecting said foot platform to said fin for pivoting said fin about its said fin axis responsive to pivoting of said foot platform about its said platform axis.

12. The fin assembly of claim 11, said transmission means including gear means such that said fin pivots at a different angular velocity than said foot platform.

13. The fin assembly of claim 11, said transmission means including:

an elongate shaft including:
- a vertical longitudinal axis;
- an upper end for joining to said foot platform; and a lower end for joining to said fin; and wherein said shaft is substantially disposed within a through hole passing from the top to the bottom of the board.

14. The fin assembly of claim 11 wherein said platform axis and said fin axis are substantially parallel.

15. The fin assembly of claim 11, said foot platform including a generally planar foot engaging area for receiving and engaging a user's foot; and wherein said fin axis is substantially perpendicular to said foot engaging area.

16. The fin assembly of claim 11 wherein said fin and said transmission means are adapted for being removed from the board such that no portion of said fin assembly projects below the bottom of the board when said fin and said transmission means are removed.

17. A method for propelling a sportboard over a fluid medium; including the steps of:

providing a sportboard with at least one fin assembly mounted thereon; the assembly having a foot platform pivotable about a platform axis for supporting a user's foot and for pivoting about the platform axis responsive to input of force from a user's foot, a fin disposed below the board and pivotable about a substantially vertical fin axis, for transmitting force to the fluid medium, and transmission means connecting the foot platform to the fin for pivoting the fin about the fin axis responsive to pivoting of the foot platform about the platform axis;

engaging at least one foot with one foot platform;

pivoting the at least one foot such that force is transmitted by the fin to the medium over which the board is supported, causing the board to move.

18. The method of claim 17, wherein the step of providing a sportboard with at least one fin assembly mounted thereon includes providing a sportboard with a plurality of fin assemblies mounted thereon.

19. The method of claim 17, the transmission means consisting of a connecting shaft; the step of providing a sportboard with at least one fin assembly mounted thereon further including the steps of:

providing the at least one fin assembly;

providing at least one through hole from top to bottom through a sportboard; and mounting the at least one fin assembly on the sportboard; including the steps of:

locating the foot platform above the sportboard;

locating the fin below the bottom of the sportboard;

passing a connecting shaft through a through hole; and joining the foot platform and the fin by the connecting shaft such that force input by the foot on the foot platform is transmitted by the connecting shaft to the fin as a torque force.

* * * * *